United States Patent [19]

Rutledge, Jr. et al.

[11] 4,422,508

[45] Dec. 27, 1983

[54] METHODS FOR PULLING SUCKER ROD STRINGS

[75] Inventors: Woodrow T. Rutledge, Jr.; Russel P. Rutledge; John E. Freeman, Jr., all of Big Spring, Tex.

[73] Assignee: Fiberflex Products, Inc., Big Spring, Tex.

[21] Appl. No.: 296,633

[22] Filed: Aug. 27, 1981

[51] Int. Cl.[3] ..... E21B 17/06; E21B 19/16

[52] U.S. Cl. ..... 166/376; 166/377

[58] Field of Search ..... 166/68, 68.5, 277, 376, 166/377, 176; 403/2; 285/2; 74/581, 584

[56] References Cited

U.S. PATENT DOCUMENTS

| | | | |
|---|---|---|---|
| 2,300,711 | 11/1942 | Staerker | 403/2 |
| 2,889,162 | 6/1959 | Norris | 403/2 |
| 3,486,557 | 12/1969 | Harrison | 166/68 |
| 3,809,162 | 5/1974 | Sydor | 166/377 |

*Primary Examiner*—Ernest R. Purser
*Attorney, Agent, or Firm*—Guy E. Matthews

[57] ABSTRACT

A method and means for pulling a sucker rod string from a well is disclosed. A separable connector is provided in the sucker rod string above the pump body. The connector comprises a male and a female section having aligned openings and joined by a shear pin within said openings. The force required to shear the pin and separate the sections of the connector is substantially greater than that required for normal operation of a downhole reciprocating pump or similar tool but is substantially less than the weight of the fluid column above the downhole reciprocating pump. The disclosed methods include insertion of this connector into a sucker rod string, such as one including fiberglass sucker rods, above the pump. The pump is then operated in the normal known fashion. To remove the sucker rod string, tension in the string is increased above that required to operate the pump until the pin within the connection shears, separating the sucker rod string from the pump. The sucker rod string may then be removed from the well and a parrafin scraper inserted therein to remove accumulated scale and parrafin from the inner wall of the tubing before the pump is fished out of the well. This invention prevents the pump from stripping the scale and parrafin from the tubing during the removal operation which may damage the pump or cause it to become stuck in the tubing. This also prevents the necessity of rotating a sucker rod string, particularly one including fiberglass sucker rods which have a low resistance to torque, to free a stuck pump.

2 Claims, 4 Drawing Figures

METHODS FOR PULLING SUCKER ROD STRINGS

BACKGROUND OF THE INVENTION

This invention relates to methods and means for pulling sucker rod strings and more particularly to a separable connector for use in a well in conjunction with a reciprocating pump in the lower portion of the well and a string of sucker rods used in actuating the pump from the surface.

Downhole reciprocating pumps have been used for years within tubing and casing to lift a column of fluid such as crude oil up the well bore to the surface of the earth. These pumps have been actuated by strings of sucker rods which connect the downhole pump to reciprocating walking beam motors at the surface. The downhole pump is typically tubular in shape with an exterior diameter substantially the same as the interior diameter of the tubing or casing. It is inserted into the tubing or casing at the surface with the sucker rod string attached and lowered into the well until it seats upon an internal shoulder of the tubing or casing provided for that purpose. In operation, the sucker rod string reciprocates a piston within the pump. The weight of the column of fluid above the pump keeps the pump seated upon the shoulder. Since the area of the pump piston is significantly less than the cross-sectional area of the pump, the upward lift required to raise the pump piston is significantly less than the downward force of the fluid column acting on the entire pump, therefore the pump is not unseated during normal operation.

Over an extended period of operation, the fluid in the column above the pump corrodes the inner surface of the tubing and deposits precipitates, such as parrafin, thereon. When it is desired to remove the downhole pump from the well, the sucker rod string may be used to lift the pump to the surface. Since the diameter of the pump is significantly greater than that of the internal piston, the weight of the fluid column upon the sucker rods in this operation is greater than the tensile load on the sucker rods in normal operation. Since the outer diameter of the pump is substantially equal to the inner diameter of the tubing, the pump will engage any corrosion scale or parrafin deposited upon the inner surface of tubing as it is raised therein. The downhole pump body will then either strip this scale and parrafin from the inner wall of the tubing, a task for which it is not adapted and which may damage the pump, or the pump body will become stuck in the tubing. To free the stuck pump, the operator must increase the tension on the sucker rod string or rotate the string and attached pump within the tubing, either of which can result in damage to the pump or the tubing.

Recently, fiberglass sucker rods, such as those disclosed in U.S. Pat. Nos. 2,874,937; 2,874,938; and 4,195,691, and abandoned U.S. Application Ser. No. 956,740 referenced in U.S. Pat. No. 4,195,691, and Canadian Pat. No. 1,072,191, based on U.S. Application Ser. No. 576,731, have begun to replace some or all of the steel sucker rods used in a sucker rod string. Although fiberglass sucker rods have significant advantages, including light weight and corrosion resistance, they are easily damaged by twisting. Therefore a stuck pump body connected to a sucker string which includes fiberglass sucker rods cannot be freed by twisting the string and the pump.

It is an object of this invention to provide methods and means for withdrawing sucker rod strings from a well bore.

It is a further object of this invention to provide methods and means for withdrawing a downhole reciprocating pump or a similar tool from a well bore without stripping the tubing with the pump, damaging the pump by using it to strip the tubing, or twisting the sucker rod string to free a pump stuck within the tubing.

It is a further object of this invention to provide methods and means for use with a sucker rod string which includes fiberglass sucker rods which will permit routine operation of a downhole reciprocating pump but which will permit the operator at the surface to separate the sucker rod string from the pump when he so desires.

SUMMARY OF THE INVENTION

The present invention discloses a method and means for pulling a sucker rod string from a well. The invention makes use of the differential between the weight of the fluid column above the pump piston and the significantly greater weight of the fluid column above the entire pump body. A separable connector is provided in the sucker rod string above the pump body. The connector is designed to separate when a predetermined tension load is applied to it. This load is greater than the operating load upon the sucker rod string, which is dependent upon the weight of the fluid column above the piston area, but is less than the weight of the fluid column above the entire pump body. The connector itself includes a male and a female section which, when engaged, have an aligned, transverse passage therethrough into which a shearable pin is fitted. This shearable pin provides the only means for transmitting a tension load from one section to the other section of the connector. When the tensile load applied to the connector is greater than the capacity of the shearable pin, the pin will shear and the connector will separate.

The disclosed methods of removing a downhole pump or other device includes the provision of such a separable connector in the sucker rod string above the downhole pump upon its insertion into the well. When it is desired to remove the pump, the operator applies tension to the sucker rod string and the pump piston attached thereto to the end of its upward travel within the pump. Tension is then increased until the shearable pin shears an the connection separates, while the weight of the fluid column above the pump body prevents the pump from being raised from its seat. The sucker rod string is then withdrawn from the well in a known manner, leaving the pump behind. Then a known tubing stripping tool such as a parrafin cutter may be inserted into the top of the well bore, run down its length to remove the scale and parrafin on the inner surface of the tubing and withdrawn through the top of the bore. Finally, a known fishing tool may be lowered into the well bore and attached to the downhole pump, which may then be removed from the well bore without engaging scale or parrafin.

BRIEF DESCRIPTION OF THE DRAWINGS

Other objects and advantages of the invention will become apparent upon reading the following detailed description and upon reference to the drawings, in which.

While the invention will be described in connection with a preferred embodiment and procedure, it will be understood that it is not intended to limit the invention to that embodiment or procedure. On the contrary, it is intended to cover all alternatives, modifications, and equivalents as may be included within spirit and scope of the invention as defined by the appended claims.

DETAILED DESCRIPTION OF THE PRESENT INVENTION

Figures 1, 2:
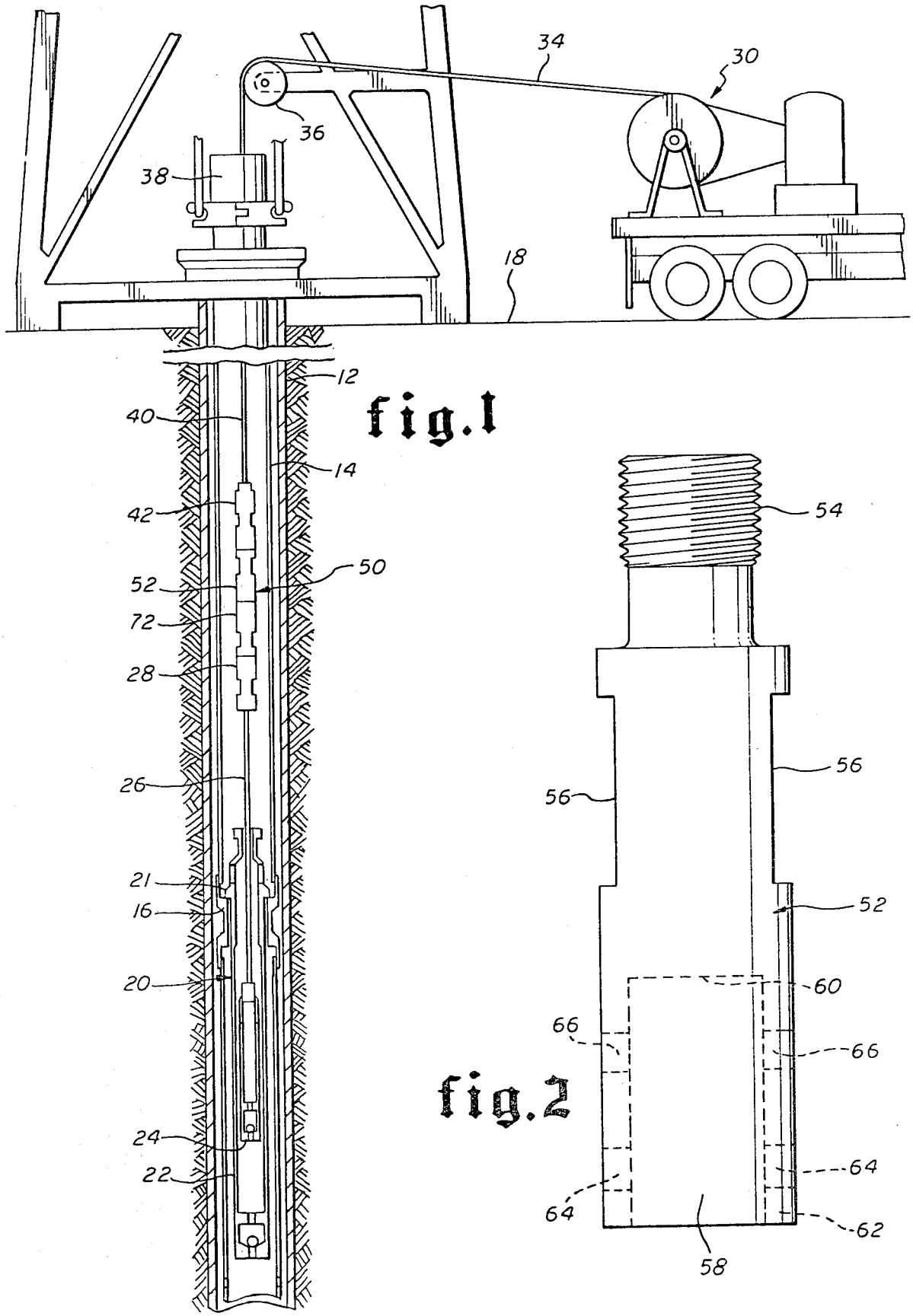
FIG. 1 is a vertical, partial sectional view having positioned therein a reciprocating pump and a sucker rod string including the separable connector of the present invention.
FIG. 2 is an enlarged side view of the female portion of the separable connection of the present invention.

Referring now to the drawings and first to FIG. 1 which shows a well bore 10 having positioned a casing 12 therein and having a production tubing 14 inserted therein. The production tubing 14 includes an internal shoulder 16, upon which is seated an external shoulder 21 of a downhole pump 20. The pump 20 includes a barrel 22 enclosing a movable piston 24. The piston 24 is motivated by a piston rod 26 which includes a connector 28. The connector 28 is threadably engaged to a separable connector 50. The upper end of the separable connector 50 is threadedly engaged to a connector 42 of a sucker rod string 40. When the downhole pump 20 is in operation, the upper end of the sucker rod string 40 is connected to a reciprocating motor, not shown, at the surface of the earth 18. When it is desired to remove the downhole reciprocating pump 20 from the well bore 10, because of a malfunction or any other reason, the sucker rod string 40 is disconnected from the reciprocating motor and is connected instead to a connector 38 acting through a wire line 34 over a sheave 36 to a tension means 30, commonly truck mounted.

Figure 4:
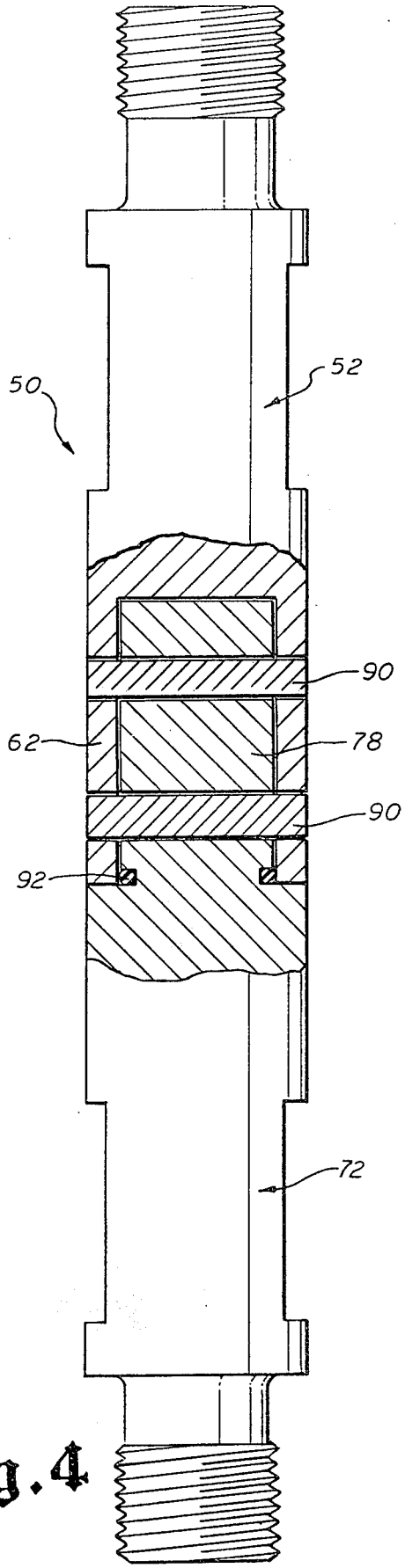
FIG. 4 is an enlarged partial sectional side view of the assembled separable connection of the present invention.

Referring now to FIG. 4, the separable connector 50 is shown assembled. It is composed of a female section 52 and a male section 72 which are joined together by one or more shearable pins 90. The female connector 52 is shown isolated in FIG. 2. It comprises a circular cylindrical body having a threaded end portion 54 at one end and a generally circular opening 58, which extends inwardly to a face 60, at the other end. The portion of the body of the female section 52 which surrounds the opening 58 comprises an annular wall 62. The annular wall 62 is penetrated by one or more opposed, coaxial pairs of holes such as a pair 64 and a pair 66. The female section is also provided with a one or more pair of opposed flats 56 intermediate the two ends of the body for the application of a wrench used for the rapid connection of the connector 50 to a sucker rod, not shown, at the threaded end portion 54, which may be threaded in accordance with the American Petroleum Institute standards.

Figure 3:
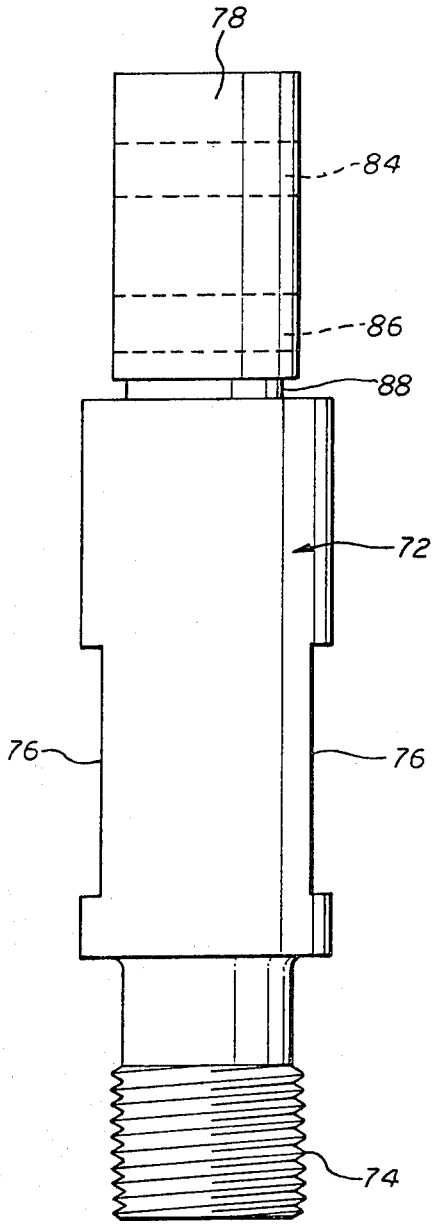
FIG. 3 is an enlarged side view of the male portion of the separable connection of the present invention.

FIG. 3 shows the male section 72 of the shearable connector 50. It comprises a circular cylindrical body having a threaded end member 74 at one end and a reduced diameter end portion 68 at the opposite end. The reduced diameter end portion 68 includes one or more transverse openings such as openings 84 and 86. A groove 88 encircles the reduced diameter portion 78 at its junction with the central body of the male section 72. The male section 72 also has one or more pair of opposed flats 76 intermediate its ends for the application of a wrench used in the rapid connection of the threaded end portion 74 to either a sucker rod or the downhole reciprocating pump.

FIG. 4 shows the female section 52 and the male section 72 assembled into the complete separable connector 50. The exterior diameter of the reduced diameter portion 78 of the male section 72 is substantially equal to the interior diameter of the central bore 58 of the female section 52. When the male section 72 is inserted into the female section 52, the pairs of holes 64 and 66 of the female section 52 align themselves with the transverse openings 84 and 86 of the male section 72. Shearable pins 90 and 92 are press fitted into the passageways formed by the aligned openings 64 and 84 and 66 and 86. A resilient O-ring 94 in the circular groove 88 seals the assembled separable connector 50.

The separable connector 50 will separate by shearing the shearable pins 90 and 92 when a tension load greater than a predetermined load is applied. The predetermined load can be controlled by varying the diameters of the transverse openings 64 and 84 and 66 and 86 and the shearable pins 90 and 92 and by modifying the composition of the shearable pins 90 and 92. In the use set out in this preferred embodiment, it is desirable that the shearing load be substantially greater than the weight of a column of fluid whose area is that of the movable pump piston 24 and whose height is the depth of the well, and that this shearing load be substantially less than the weight of the column of fluid whose area is the cross-sectional area of the pump body and whose height is the depth of the well. Thus the separable connector 50 will remain fixed upon any upward movement of the pump piston 24 but will separate before upward movement of the pump body 22 may be accomplished.

In operation, the separable connector of the present invention is connected between the piston rod 26 of the downhole pump 20 and the sucker rod string 40 at the time the pump 20 and string 40 are inserted into the well bore 10. Subsequently, when it is desired to remove the pump 20 from the well bore 10, the suitable tension means 30 are connected to the upper end of the sucker rod string 40 by the wire line 34 over the sheave 36 to the connector 38. Tension is applied to the sucker rod string 40 thereby raising the movable pump piston 24 within the pump body 22 until it reaches the upper end of its travel within the pump 20. At this point, increased tension on the sucker rod string 40 is required to attempt to lift the pump 20 from its seat on the tubing shoulder 16 within the production tubing 14. However before the tension required to accomplish this can be achieved, the predetermined shearing load of the separable connector 50 is reached and the pins 90 and 92 shear, separating the sucker rod string 40 from the downhole pump 20. The sucker rod string 40 is then withdrawn from the well by the tension means 30 in known manner.

Next, a known parrafin scraper, not shown, may be inserted into the tubing 14 attached to a wire line unit, not shown, run down the tubing 14 to the location of the pump 20, and then withdrawn out the top of the tubing 14. This operation removes any parrafin or other precipitate as well as any corrosion scale from the inside surface of the tubing 14. Finally, a known fishing tool, not shown, may be inserted into the tubing 14 and lowered to and attached to the pump 20, which may then be withdrawn up the tubing 14 and out the top of the well bore 10 without any interference from parrafin or corrosion scale formerly on the inside surface of the tubing 14.

Thus it will be appreciated that shearable connector of the present invention has overcome the possible disadvantage that the low torque resistance of a fiberglass sucker rod string provides in removing a downhole reciprocating pump 20 or a like device from a well bore 10. The present invention eliminates the requirement that sucker rod string 40 be able to withstand the high torque necessary to rotate the downhole reciprocating pump in order to free it from parrafin and scale accumulations encountered on the inside surface of the production tubing 14 while conventionally withdrawing the pump 20 from the production tubing 14.

Thus it is apparent that there has been provided, in accordance with the invention, a method and means for pulling a sucker rod string that fully satisfies the objects, aims, and advantages set forth above. While the invention has been described in conjunction with specific embodiments thereof, it is evident that many alternatives, modifications, and variations will be apparent to those skilled in the art in light of the foregoing description. Accordingly, it is intended to embrace all such alternatives, modifications, and variations as fall within the spirit and broad scope of the appended claims.

What is claimed is:

1. A method of enabling the combination of steel suckers rods and fiberglass sucker rods to be joined together to form a sucker rod string which are connected to a downhole reciprocating pump to be pulled from a tubing string of a well comprising the steps of:

(a) installing a separable connector having at least one shear pin therein between the sucker rod string and the downhole reciprocating pump, such separable connector being joined only by said shear pin;

(b) applying a tension force to the sucker rod string, wherein said tension force is significantly greater than the tension force required for normal operation of the downhole reciprocating pump, and then shearing the pin of the separable connector, whereby the sucker rod string is disconnected from the downhole reciprocating pump; and, (c) pulling the sucker rod string from the tubing without the downhole reciprocating pump being attached thereto, thereby preventing the downhole reciprocating pump from stripping accumulated scale, parrafin, and other precipitate from the interior surface of the tubing string and thereby eliminating the necessity of rotating the sucker rod string to free the downhole reciprocating pump from an engagement with the accumulated scale, parrafin, and other precipitate which otherwise prevents the continued removal of the downhole reciprocating pump from the tubing.

2. A method as recited in claim 1 wherein the separable connector is installed directly connected to the downhole reciprocating pump.

* * * * *